United States Patent [19]

Luchaco et al.

[11] Patent Number: 4,540,917

[45] Date of Patent: Sep. 10, 1985

[54] PULSE NETWORK FOR FLUORESCENT LAMP DIMMING

[75] Inventors: David G. Luchaco, Macungie; Jonathan H. Ference, Point Pleasant, both of Pa.

[73] Assignee: Lutron Electronics Co., Inc., Coopersburg, Pa.

[21] Appl. No.: 482,148

[22] Filed: Apr. 5, 1983

[51] Int. Cl.[3] ..... G05F 1/00; H05B 37/02; H05B 39/04; H05B 41/36

[52] U.S. Cl. ..... 315/291; 315/DIG. 4; 315/206; 315/242; 315/245

[58] Field of Search ..... 315/DIG. 2, DIG. 4, 315/206, 207, 208, 291, 242, 243, 205, 245

[56] References Cited

U.S. PATENT DOCUMENTS

| | | | |
|---|---|---|---|
| 2,748,318 | 5/1956 | Laird | 315/243 X |
| 3,344,310 | 9/1967 | Nuckolls | 315/DIG. 4 |
| 4,005,336 | 1/1977 | Casella | 315/243 |
| 4,284,925 | 8/1981 | Bessone et al. | 315/DIG. 4 |
| 4,350,935 | 9/1982 | Spira et al. | 315/291 |

*Primary Examiner*—Saxfield Chatmon

*Attorney, Agent, or Firm*—Ostrolenk, Faber, Gerb & Soffen

[57] ABSTRACT

A pulse network is connected to the inductive ballast of a fluorescent lamp dimmer and includes a discharge resistor in parallel with the pulse network capacitor. The resistor size is such that it will completely discharge the capacitor prior to the initiation of any phase delayed half wave voltage which is applied to the ballast.

14 Claims, 4 Drawing Figures

PULSE NETWORK FOR FLUORESCENT LAMP DIMMING

BACKGROUND OF THE INVENTION

This invention relates to control of the energization of gas discharge lamps, and more particularly relates to a novel pulse network for the ballast of a fluorescent lamp which is to be dimmed by a phase control unit.

It is well known that fluorescent lamps can be dimmed through the use of thyristor-type phase control units in series with an inductive ballast and the lamp. The terms thyristor phase control or thyristor switching will be used hereinafter to broadly designate the well known phase control function which can be obtained by any suitable switching device such as a thyristor, triac, transistor, break-over diode, or the like. When the ballast is a simple series inductor, phase control can produce dimming of the lamp output to about 20% of the available light output of the lamp. However, when dimming below 20% , severe lamp flicker and uneven light output between parallel lamps will occur.

The performance of such dimming circuits and lamps can be improved by increasing the supply voltage and the ballasting inductance. By increasing supply voltage, there will be a more continuous flow of energy to the lamp arc during the off period of the thyristor or other switch device to prevent lamp deionization during the off period.

It is also known to employ a pulse forming circuit connected to a tap on the ballast inductance. Thus, a series connected resistor and capacitor forming the pulse network are connected to a tap on a series ballast. During the beginning of the conduction within each phase controlled cycle, the pulse network will appear as a low impedance, and will cause transformer action between the tapped sections of the inductor. Thus, a high voltage can be applied to the lamp to ensure its adequate striking under substantial phase controlled conditions. As the capacitor of the series capacitance and resistive circuit charges, the transformer action reduces and the main power source is eventually applied to the lamp through the series inductance circuit. This arrangement has been found to produce positive ionization of the plasma within the lamp each half cycle and provides repeatable lamp conduction characteristics from cycle to cycle so long as the a-c supply voltage is high enough, and so long as the frequency is relatively high (greater than about 50 Hz.). When the frequency is low, for example 50 Hz., the lamp or parallel lamps tend not to reionize completely, particularly at the low end of the dimming range. This gives rise to lamp flicker and poor matching of light output between lamps when dimming below 10% of full light output.

To overcome this problem, it is a common expedient to impress an incandescent lamp load directly in parallel with the tapped portion of the ballast inductor and the pulse network. The incandescent lamp load is about 10 watts for each fluorescent lamp which is in the entire system driven from a common phase control assembly. When an incandescent lamp load of this size is applied across all parallel ballasts of a system, the pulse network can produce excellent dimming operation to below 1% of the available light output of the lamps with no significant lamp flicker. Thus, in an installation employing 20 lamps with 20 respective ballasts, for example, a 200 watt incandescent lamp, or an equivalent resistive load, is employed for the best dimming performance.

The use of incandescent lamps in addition to the pulse network wastes power. Moreover, the additional resistive load is commonly added by the equipment installer, rather than the ballast manufacturer, so that the design and connection of the load is uncontrolled, and produces an additional maintenance problem. Moreover, when ballasts and lamps are added or removed from the system, the incandescent lamp load must be changed for optimum dimming performance.

In some cases, dimmer manufacturers have included such a resistive load directly in the dimmer phase-control circuit housing. This, however, substantially increases the size of the housing because of the need for dissipating the heat approximately 10 watts for each fluorescent lamp which may be connected to the controller.

BRIEF DESCRIPTION OF THE INVENTION

It has been found that the above described incandescent or resistive load can be eliminated and replaced by a discharge resistor in parallel with the pulse network capacitor. This discharge resistor is designed to ensure complete discharge of the capacitor under any phase control delay. By completely discharging the pulse network capacitor prior to the arrival of the leading edge of the phase controlled voltage, the pulse network has a substantially zero initial voltage to ensure proper and consistent operation of the ballast and lamps under regulation conditions down to and below 1% of full light output. The resistor of the invention, connected directly across the capacitor of the pulse network, need only dissipate approximately 3 watts for each fluorescent lamp associated with the dimmer to produce good dimming down to 1% of full available light output. The discharge resistor can also be connected across the capacitor and series resistor combination and still perform the required function, but connection across the capacitor alone provides the best performance and the lowest dissipation and is therefore preferred.

It is possible to further reduce the resistive power dissipation to less than 1.5 watts per lamp by employing a positive temperature coefficient (PTC) resistive element as the resistor of the invention in applications which do not require rapid large changes in light output. A representative device is the P52E102NF12 manufactured by TDK Electronics Co., Ltd. of Tokyo, Japan. Such a device exhibits a very rapid increase in resistance when its temperature reaches a certain value. Therefore, at high light output levels, a high RMS voltage appears across the pulse network, and the PTC device will self-heat and cause its resistance to increase, limiting further power dissipation. The high resistance value is of no consequence when operating at a relatively high light output level. When the dimmer output is decreased, the PTC device cools off and its resistance drops to a low enough value to properly discharge the pulse capacitor. The power limiting characteristic at high output levels results in the improved performance of the PTC device relative to a fixed value discharge resistance. However, if dimmer output is rapidly changed from a high value to a low value, the thermal time constant of the PTC device prevents it from instantaneously readjusting its value, so there may be a 15 to 20 second period of lamp flicker immediately after the output is reduced, while the PTC device cools and its resistance drops to a suitable value for discharging the pulse capacitor. This limits the usefulness of the PTC device to applications not requiring rapid large changes in light level.

In accordance with the invention, each pulse network for each lamp (or pair of lamps) is totally self-contained and may be placed conveniently within the ballast or lamp fixture. By contrast, a single incandescent lamp load of the prior art is used for all of the fluorescent lamps and pulse networks of any given installation. Thus, the installer had to be cautious about changing the value of the incandescent load as different numbers of lamps and fixture combinations were installed. With the present invention, the resistor is built into the pulse network and its value is inherently correctly sized for the lamp or lamps associated with the given fixture.

In the past, the resistive load was thought to provide only for thyristor latching and holding current. In fact, it is believed that the resistive load also operates to discharge the pulse network capacitor during thyristor non-conduction intervals. If the resistive load is not present, the only discharge path for the capacitor in the prior art pulse network is through the thyristor itself in a highly variable manner, causing flicker and poor lamp matching. Therefore, the amount of residual charge in the prior art pulse network was greatly dependent on the thyristor turnoff dynamics which vary from device to device and from cycle to cycle for the same device. Thus, on the next half cycle the amount of residual charge influenced the amplitude of the high voltage restrike pulse which was generated.

With the present invention, discharge of the pulse network capacitor is ensured by its own correctly sized discharge resistor so that each pulse will be generated from the same initial stored charge value (preferably zero). This accounts for the improved dimming performance which is obtained with the novel pulse network of the invention, compared to prior art pulse dimming systems which do not use the resistive load or use a single resistive load which dissipates less than about 10 watts for each fluorescent lamp in the system.

DETAILED DESCRIPTION OF THE DRAWINGS

Figure 1:
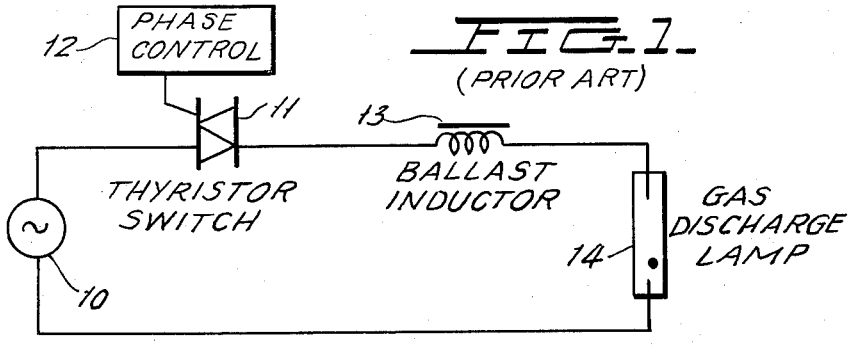
FIG. 1 (PRIOR ART)
FIG. 1 is a schematic diagram of a prior art dimming circuit for a gas discharge lamp, such as a fluorescent lamp, which employs thyristor switching and a series ballast inductor.

Referring first to FIG. 1, there is shown therein an a-c supply source 10 which can, for example, be 230 volts RMS at 50 Hz. The source 10 is connected in series with a schematically illustrated triac 11. Triac 11 can be replaced by anti-parallel connected thyristors arranged in the well known manner to produce a-c phase control switching. Any other type of high-speed switching device can be employed which will produce the effect of phase control operation. The term thyristor phase control shall be used to describe the operation of the switching device 11, whereby in each half wave, the application of voltage from the source 10 to any load can be delayed in each half wave by any desired angle. The phase control switching will be controlled by a suitable phase control circuit 12 which can have any standard design and which can be operable, for example, by a rotatable or other movable manual control, not shown.

Source 10 and switching device 11 are connected in series with any desired number of parallel connected sets of ballasts and lamps. A single set is shown, consisting of ballast indicator 13 of any standard design and series connected gas discharge lamp 14. Gas discharge lamp 14 can be of any desired type and typically can be a 40 watt fluorescent lamp. Lamp 14 may also have filament windings heated by a suitable filament heater winding (not shown) associated with the ballast.

In the circuit of FIG. 1, decreased light output is obtained by increasingly delaying, through phase control, the voltage applied to ballast indicator 13 and lamp 14. It has been found that lamps in an arrangement of the type shown in FIG. 1 can be dimmed to about 20% of full illumination before the lamp begins to flicker and before parallel connected sets of lamps assume different levels of brightness. This effect is particularly apparent when the frequency of source 11 is relatively low, for example, 50 Hz. rather than 60 Hz., since at the lower frequencies the lamp non-conduction period is greater and it is more difficult to reionize the lamp in the next half cycle. The effect is also more noticeable with lower peak voltages across the gas discharge lamp 14.

Figure 2:
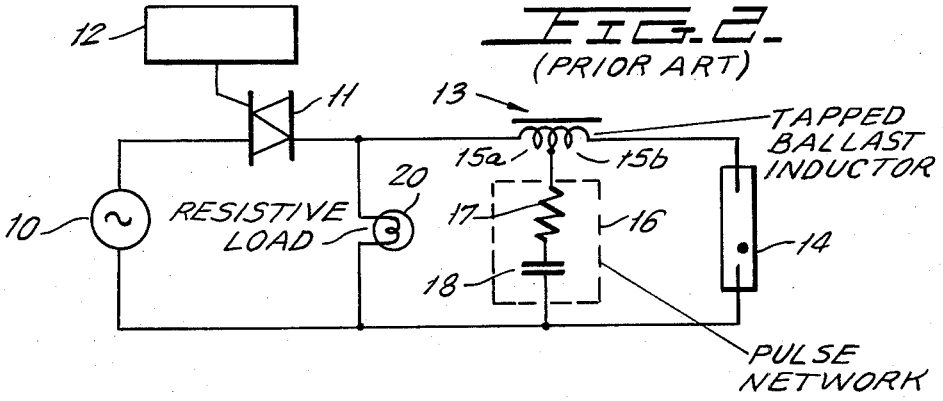
FIG. 2 (PRIOR ART)
FIG. 2 shows a further prior art circuit in which a pulse network and incandescent load is added to the circuit for improved dimming performance.

FIG. 2 shows a prior art circuit in which a pulse network circuit is added to permit more dimming of the output of the gas discharge lamp that is available from the circuit of FIG. 1. In FIG. 2, components identical to those of FIG. 1 have the same identifying numeral. In FIG. 2, the ballast inductor 13 of FIG. 1 is provided with a tap which divides the winding into sections 15*a* and 15*b*. Section 15*a* has fewer turns than section 15*b*. A pulse network 16 consisting of a series connected resistor 17 and capacitor 18 is connected as shown to the tap between winding sections 15*a* and 15*b*. The purpose of the pulse network 16 is to create transformer action between winding sections 15*a* and 15*b* at the time the instant phase delayed voltage is applied through thyristor control 11 to the inductor 13 and lamp 14. At this time, the pulse network 16 will have an extremely low impedance so that the inductor will act like a step-up transformer having primary winding 15*a* and secondary winding 15*b*, and a relatively high voltage pulse will be applied across the lamp 14. This high voltage pulse across the lamp will ensure the ionization of the lamp 14 even after a relatively long deionization period (during the phase control hold-off interval), so that lamp dimming can be obtained to lower dimming values when employing the pulse network 16. After the leading edge of the phase control voltage has passed, capacitor 18 has charged and the pulse network 16 assumes a high impedance so that the inductor 13 acts again as an inductor rather than as a transformer.

When using pulse network 16, it was the common practice to additionally employ an incandescent lamp load 20 connected across the a-c source 10 and phase control device 11. The incandescent load 20 has been thought necessary to ensure the conduction and latching of the thyristor or triac device 11 which is operated into a highly inductive ballast inductor 13. Load 20 is conventionally designed to dissipate 10 watts of power for each lamp 14 with which the control 11 is associated. Note that a plurality of ballasts 13 and lamps associated therewith could be operated from a single a-c supply 10 and thyristor control 11 and a single resistive load 20 would be associated with the single thyristor control. Thus, if a total of 20 inductors and lamps therefore are associated with a single thyristor control 11, the resistive load would be designed to dissipate 200 watts.

In accordance with one aspect of the present invention, it has been discovered that the load 20 in addition to providing latching and holding current for the thyristor control device 11 also acts to discharge the capacitor 18 of each of the pulse networks associated with the resistive load 20 to initialize them for the next half-wave operation. If, however, any of capacitors 18 are not fully discharged, as would occur if the resistive load 20 is omitted or of a value such that less than about 10 watts is dissipated per fluorescent lamp, then on the next half wave, the pulse network will operate differently than in the prior half wave, so that in inconsistent striking and dimming operation is obtained for all lamps. This is shown in circuits of the type shown in FIG. 2 by a tendency of the circuit to flicker significantly with dimming below about 1% of the total light output of the lamp 14 and by different output illumination of individual lamps.

Figure 3:
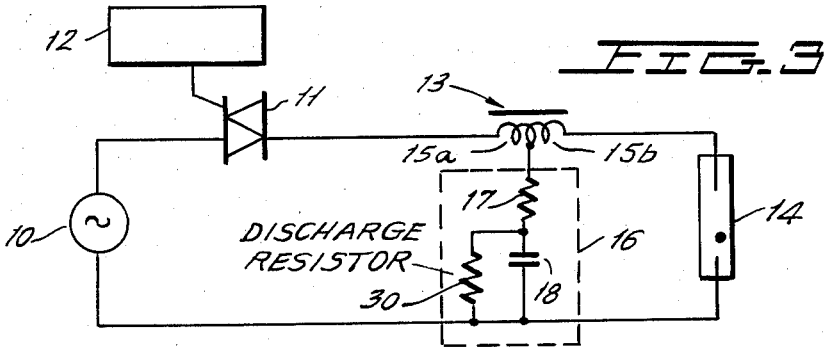
FIG. 3 schematially illustrates the circuit of the present invention in which the pulse network contains a discharge resistor which replaces the prior art incandescent load.

FIG. 3 shows a first embodiment of the present invention. Components which are identical to those of FIGS. 1 and 2 have been given identical identifying numerals in FIG. 3. The significant change in FIG. 3, as compared to the prior art circuit of FIG. 2, is the elimination of the load 20 of FIG. 2 and the addition of a discharge resistor 30 to the pulse network 16. The discharge resistor 30 is sized to ensure complete discharge of the capacitor 18 prior to the arrival of the next phase delayed voltage wave front from the thyristor control 11. By ensuring complete discharge of the capacitor 18 prior to the next conductive period, consistent operation is ensured and it has been observed that lamps 14 can be consistently and efficiently dimmed to 1% of their full illumination and below without flicker or asymmetrical brightness between individual lamps when employing the circuit of FIG. 3.

In the arrangement shown in FIG. 3, resistor 17 is a 1K resistor, capacitor 18 is a 0.1 microfarad capacitor and the novel discharge resistor 30 is a 15K resistor. The resistor 30 is designed, in accordance with the invention, to dissipate 3 watts for each lamp 14 which is associated with ballast inductor 13 and the pulse network 16. Moreover, in accordance with the invention, the novel pulse network 16 is designed as a single component which is separable from the fixture and from the ballast 13 and from the thyristor control 11. Consequently, the installer now has flexibility in mounting the various dimmer parts. Furthermore, it is unnecessary with the novel circuit of FIG. 3 to count or be concerned with the number of lamps 14 which are used since the correctly sized resistor 30 will be contained within the pulse network 16 which is associated with each of the lamp and ballast assemblies. Thus, the total resistance which will be provided is automatically correct, whereas it has to be recalculated and adjusted when employing the single resistive or incandescent load 20 of FIG. 2. Also, since the discharge resistor 30 is now an integral part of the pulse network, it is no longer necessary to be concerned about separate maintenance of the resistive load.

Figure 4:
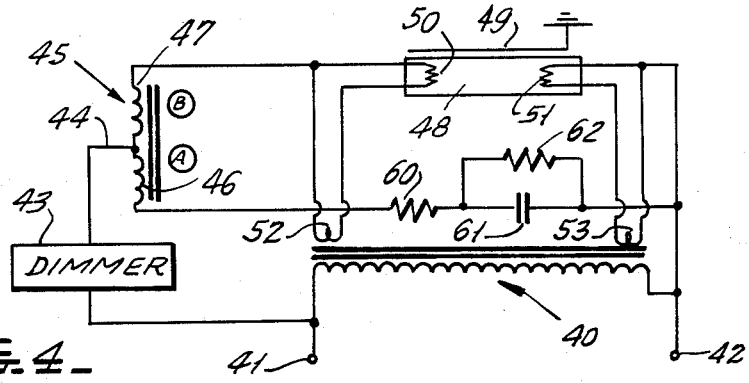
FIG. 4 is a circuit diagram of a second embodiment of the invention in which the filament heater windings are also shown and in which the ballast inductor is differently connected than in FIG. 3.

FIG. 4 shows another embodiment of the present invention and additionally shows the filament transformer for the lamp and a revised connection for the inductor. Referring to FIG. 4, there is shown, in part, a well known prior art ballast and lamp assembly which is made by Ferguson Transformers Ltd. of Chatswood N.S.W., Australia. The device is designated a 40 watt dimming ballast for single fluorescent lamps, type D140RWTP. The ballast structure includes a filament transformer 40 connected to terminals 41 and 42 which are designed for connection to an a-c power source having a voltage of 230 volts RMS at 50 Hz. A thyristor type dimmer structure 43 of construction similar to that shown in FIG. 3 is provided and connects phase controlled power from an a-c source connected to terminals 41 and 42 to the tap 44 of the two winding inductor 45. Inductor 45 has a first winding section 46 and a second winding section 47 which has more windings than section 46. A conventional 40 watt fluorescent lamp 48 having a conventional grounded shield 49 is provided with filament windings 50 and 51 which are connected to secondary windings 52 and 53, respectively, of the filament transformer 40. The outer end of winding 47 is then connected to filament 50, as shown, and filament 51 is connected to terminal 42 as shown. Also connected between the terminal 42 and the lower end of winging 46 is the series connected resistor 60 and capacitor 61 which correspond to resistor 17 and capacitor 18, respectively, in FIGS. 2 and 3.

In accordance with the present invention, the above known dimming ballast and single lamp is modified by the addition of discharge resistor 62 across the capacitor 61 which will ensure complete discharge of the capacitor before every new half wave. Note also that, when installing the ballast without the resistor 62, it is the common practice to employ an incandescent load such as the load 20 of FIG. 2 which would be connected in FIG. 4 from the tap 44 to the terminal 42. The function of this incandescent load, however, which consists of a single common incandescent load for all of the pulse dimming ballasts of the arrangement of FIG. 4, is replaced by the individual discharge resistor 62 for each of the pulse circuits.

The single resistor 62 has been found to substantially increase the performance of the ballast at a given level of resistive power dissipation and permits dimming of the lamp 48 to less than 1% of its full output illumination with a dissipation of less than 3 watts per lamp. Moreover, the novel resistor 62 substantially simplifies the installation of ballasts and can be assembled as a separate part of the dimming ballast, along with other pulse network components 60 and 61 in a separate housing from the remainder of the dimming ballast. The size of the resistor 62 is selected so that the resistor will dissipate approximately 3 watts for a single lamp 48. In a two lamp ballast, the resistor would dissipate 6 watts—3 watts for each lamp. This relatively small power can be dissipated easily in a single separate housing which may also contain resistor 60 and capacitor 61.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A pulse dimming ballast containing a pair of a-c terminals, a ballast inductor and a gas discharge lamp load each connected in series with one another and with said pair of a-c terminals; said pair of a-c terminals being excitable from an a-c source and through a phase control switching means; said ballast inductor having a winding tap; a pulse network for restriking said gas discharge lamp during each half cycle of said a-c source; said pulse network comprising a series connected resistor and capacitor connected at one end to said winding tap and at the other end to one of said pair of a-c terminals whereby said pair of a-c terminals, said phase control switching means, said pulse network and a portion of said ballast inductor are connected in series with one another; wherein the improvement comprises a discharge resistor connected directly in parallel with at least one component of said pulse network, said discharge resistor being sized to ensure substantially complete discharge of said capacitor during non-conductive periods of said phase control switching means.

2. The ballast of claim 1, wherein said gas discharge lamp load comprises at least one fluorescent lamp.

3. The ballast of claim 1, wherein said discharge resistor is sized to dissipate 3 watts for each lamp in said gas discharge lamp load.

4. The ballast of claim 1, wherein said ballast is operable at 50 Hz.

5. A lamp dimming and control system comprising a plurality of parallel connected pulse dimming ballasts which are driven in parallel from a common a-c source and are controlled by a common series connected phase control switching means; each of said pulse dimming ballasts containing a respective pair of a-c terminals, a ballast inductor, and a gas discharge lamp load, each connected in series with one another and with said pair of a-c terminals; each of said ballast inductors having a winding tap; each of said pairs of a-c terminals being excited from said common a-c source and through said common phase control switching means; each of said pulse dimming ballasts having a respective pulse network for restriking said gas discharge lamp during each half cycle of said a-c source; each of said pulse networks comprising a series connected resistor and capacitor connected at one end to their respective winding tap and at their other end to one of their respective pair of terminals; wherein the improvement comprises a respective discharge resistor connected directly in parallel with at least one component of each of said pulse networks, said respective discharge resistors being sized to ensure substantially complete discharge of their said capacitor associated therewith during non-conductive periods of said phase control switching means.

6. The system of claim 5, wherein each of said resistors is sized to dissipate 3 watts for each lamp in its said respective gas discharge lamp load.

7. The system of claim 6, wherein each of said gas dischrage lamp loads consists of at least one fluorescent lamp.

8. The system of claim 5, wherein said common a-c source has a frequency of 50 Hz.

9. The system of claim 1, wherein said phase control switching means consists of a thyristor switching circuit.

10. The ballast of claim 5, wherein said common phase control switching means consists of a thyristor switching circuit.

11. The ballast of claim 1, wherein said at least one component consists of said capacitor.

12. The system of claim 5, wherein said at least one component consists of said capacitor.

13. The ballast of claim 1, wherein said discharge resistor is a positive temperature coefficient resistor.

14. The system of claim 5, wherein said discharge resistor is a positive temperature coefficient resistor.

* * * * *